US007815755B2

(12) United States Patent
Arai et al.

(10) Patent No.: US 7,815,755 B2
(45) **Date of Patent: *Oct. 19, 2010**

(54) SEAMLESS STEEL PIPE AND MANUFACTURING METHOD THEREOF

(75) Inventors: Yuji Arai, Amagasaki (JP); Kunio Kondo, Sanda (JP); Nobuyuki Hisamune, Kinokawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/010,459

(22) Filed: Jan. 25, 2008

(65) Prior Publication Data

US 2008/0257459 A1 Oct. 23, 2008

Related U.S. Application Data

(63) Continuation of application No. PCT/JP2006/314758, filed on Jul. 26, 2006.

(30) Foreign Application Priority Data

Jul. 26, 2005 (JP) ..... 2005-216233

(51) Int. Cl.
*C22C 38/44* (2006.01)
*C22C 38/50* (2006.01)

(52) U.S. Cl. ..... 148/335; 420/109

(58) Field of Classification Search ..... 148/519, 148/520, 570, 590, 622, 636–638, 320–337, 148/909; 420/89–93, 104–106, 109–112, 420/119–128

See application file for complete search history.

(56) References Cited

U.S. PATENT DOCUMENTS 6,517,643 B1 * 2/2003 Asahi et al. ..... 148/320

FOREIGN PATENT DOCUMENTS

| | | | |
|---|---|---|---|
| JP | 56-166324 | | 12/1981 |
| JP | 09-235617 | * | 9/1997 |
| JP | 2000-104117 | * | 4/2000 |
| JP | 2000-169913 | * | 6/2000 |
| JP | 2001-240913 | | 9/2001 |
| JP | 2004-124158 | | 4/2004 |
| WO | WO 2004-031420 | * | 4/2004 |

OTHER PUBLICATIONS

English translation of Takeshi—JP 2000-104117, published Apr. 2000, 27 pages total.*

* cited by examiner

*Primary Examiner*—George Wyszomierski
*Assistant Examiner*—Mark L Shevin
(74) *Attorney, Agent, or Firm*—Clark & Brody

(57) ABSTRACT

The present invention relates to the following seamless steel pipes excellent in strength, toughness and weldability, particularly suitable for submarine flow lines, and a manufacturing method thereof. An as-quenched seamless steel pipe having a chemical composition consisting of, by mass%, C: 0.03 to 0.08%, Mn: 0.3 to 2.5%, Al: 0.001 to 0.10%, Cr: 0.02 to 1.0%, Ni: 0.02 to 1.0%, Mo: 0.02 to 0.8%, Ti: 0.004 to 0.010%, N: 0.002 to 0.008%, Ca: 0.0005 to 0.005%, and the balance Fe and impurities, with not more than 0.25% of Si, not more than 0.05% of P, not more than 0.005% of S, less than 0.005% Nb, and less than 0.0003% of B as the impurities, and having a microstructure consisting of not more than 20 volume% of polygonal ferrite, not more than 10 volume% of a mixed microstructure of martensite and retained austenite, and balance bainite. B can be 0.0003 to 0.001%. Mg and/or REM can be contained. The manufacturing method is characterized by the cooling rate during quenching.

4 Claims, No Drawings

SEAMLESS STEEL PIPE AND MANUFACTURING METHOD THEREOF

This application is a continuation of International Patent Application No.

PCT/JP2006/314758, filed Jul. 26, 2006. This PCT application was not in English as published under PCT Article 21(2).

TECHNICAL FIELD

The present invention relates to seamless steel pipes excellent in strength, toughness and weldability, particularly relates to thick wall, high strength seamless steel pipes suitable for submarine flow lines, and a manufacturing method thereof. The thick wall means a wall thickness of not less than 25 mm. The high strength means a strength of not less than X70 defined in API (American Petroleum Institute), specifically, strengths of X70 (yield strength of not less than 483 MPa), X80 (yield strength of not less than 551 MPa), X90 (yield strength of not less than 620 MPa), X100 (yield strength of not less than 689 MPa), and X120 (yield strength of not less than 827 MPa).

BACKGROUND ART

In recent years, petroleum and gas resources located on land and in shallow sea areas are being depleted, and deep-sea submarine oil fields have been actively developed. In a deep-sea oil field, crude oil or gas has to be carried from a wellhead set on the sea bottom to a floating platform by use of a flow line or a riser.

A flow line laid in the deep sea that accepts high internal fluid pressure with a deep formation stratum pressure to the inside suffers repeated distortion due to ocean waves and, during an operation stop, deep-sea water pressure. Therefore, steel pipes for the above-mentioned flow line require thick wall stainless pipes with high strength and high toughness, when considering a collapse and metal fatigue, in addition to the strength.

Such a seamless steel pipe with high strength and toughness has previously been manufactured by piercing a billet heated to a high temperature by a piercing mill, rolling and elongating it into a pipe shape product, and then performing a heat treatment. By this manufacturing process, high strength, high toughness and weldability are given to the steel pipe.

In recent years, from the viewpoint of the energy saving and short-cut process, simplification of the manufacturing process has been examined by applying inline heat treatment, that is, a heat treatment in pipe making line. Particularly, paying attention to effective use of the heat of steel after hot-working, a process of quenching a pipe without cooling to room temperature after making in a pipe is introduced, whereby significant energy saving and an increase in efficiency of the manufacturing process can be attained, which effectively reduces the manufacturing cost.

The inline heat treatment process, quenching directly after finish rolling, tends to cause coarse-grained crystal, because the process does not cool the steel pipe to room temperature after rolling, and the steel pipe does not undergo the transformation and reverse transformation process. This results in the difficulty of obtaining good toughness and corrosion resistance.

Therefore, several techniques have been proposed in order to solve this problem. One is a technique for making fine-grained crystal of the finish-rolled steel pipe. Another is a technique that ensures the toughness and corrosion resistance even in a steel pipe having so fine-grained crystal.

For example, the following Patent Document 1 discloses a technique for making the fine-grained crystal after finish rolling, which reduces the steel pipe temperature once to a low temperature ($Ac_1$ transformation point—100° C.) before putting it into the reheating furnace, by adjusting the time from the finish rolling to the putting it into the reheating furnace.

The following Patent Document 2 discloses a technique for manufacturing a steel pipe that has a satisfactory performance even with relatively large grained crystal by adjusting the chemical composition, particularly, the contents of Ti and S.

[Patent Document 1]

Japan Patent Unexamined Publication No. 2001-240913

[Patent Document 2]

Japan Patent Unexamined Publication No. 2000-104117

The recent activated development of large depth submarine oil fields leads to an increase in demand of thick wall steel pipes with high strength. However, it is difficult to provide sufficient performances to the steel pipes by the techniques disclosed in the above patent documents. In thick wall steel pipes that are intended by the present invention, for example, the temperature of finish rolling is increased, and excessive time is needed until the temperature of the steel pipes is down to the required low temperature ($Ac_1$ transformation point—100° C.), thereby the production efficiency is significantly reduced. Therefore, it is difficult to apply the method disclosed in the Patent Document 1 to the thick wall pipes. Furthermore, since the cooling rate of the inline heat treatment for the thick wall pipes is small, the steel having a composition disclosed in the Patent Document 2 also has the problem of deterioration of toughness.

DISCLOSURE OF THE INVENTION

Problems to be solved by the Invention

The present invention has been made in the above-mentioned circumstances. It is an objective of the present invention to provide a seamless steel pipe with a particularly large wall thickness, which has high strength, stable toughness and excellent corrosion resistance and which is suitable for submarine flow lines. It is another objective of the present invention to provide an as-quenched seamless steel pipe suitable as a material for manufacturing this seamless steel pipe, and also to provide a method for manufacturing these pipes.

Means for Solving the Problem

As a result of the detailed analyses of factors governing the toughness of thick wall seamless steel pipes with high strength, the present inventors obtained the following findings of (1) to (6), and confirmed that a seamless steel pipe for line pipes having high strength of X70 class or more, and extraordinary toughness with a wall thickness of not less than 25 mm can be manufactured in an inline heat treatment that is an inexpensive process with high efficiency.

(1) The toughness of the seamless steel pipe with wall thickness of not less than 25 mm after quenching and tempering heat-treatment varies on the condition of quenching. Namely, the microstructure of the as-quenched steel pipe governs the toughness after tempering.

(2) The microstructure of the as-quenched steel pipe is based on upper bainite including slight ferrite. However, cementite or "mixed microstructure of retained austenite and martensite" (hereinafter referred to as MA) is in a needle shape or granular shape in the interfaces of the upper bainite microstructure such as prior austenite grain boundary, boundary with packet, boundary with block and interface between laths.

(3) When the MA is excessive in the interfaces of the upper bainite microstructure of the as-quenched steel pipe, these parts are embrittled because of a large difference in hardness between the MA and the base phase around it, and the toughness is poor even after tempering is performed thereto.

(4) In order to enhance the toughness after tempering, the MA in the as-quenched steel pipe needs to be controlled to not more than 20% by volume ratio in the entire microstructure of the steel, preferably to not more than 10%, and further preferably to not more than 7%. The retained austenite amount in the MA is controlled preferably to not more than 10% in the entire microstructure of the steel, more preferably to not more than 7%, and further preferably to not more than 5%.

(5) With respect to the chemical composition of the alloy, an addition of alloy elements such as Mn, Cr, and Mo lead to obtaining an upper bainite-based microstructure that ensures an increased strength, and an addition of the proper amount of Ti with a lesser amount of C and Si leads to minimizing the MA that improves the toughness after tempering. Further, an addition of a small amount of elements such as Ca, Mg and REM, and an addition of the proper amount of precipitation strengthening elements such as Cu and V, respectively, extremely improve the balance between strength and toughness after tempering.

(6) When tempering is performed to the as-quenched steel pipe reduced in the amount of MA as described above in a temperature range from 550° C. to $Ac_1$ transformation point, satisfactory toughness can be stably obtained.

The present inventors examined a method for enhancing the toughness in manufacturing a thick wall seamless steel pipe with high strength through the inline heat treatment process, which comprises quenching the steel pipe while the temperature of the steel pipe is not lower than the $Ar_3$ transformation point, immediately or after soaking the steel pipe in a holding furnace at a temperature of not lower than the $Ac_3$ transformation point, after hot rolling a billet as a material to make a steel pipe, and tempering. As a result, the following points became known.

Even if the treatment is performed by the same heat treatment facility, the balance between strength and toughness is deteriorated for the pipes of thick wall. Of particular importance, it was found that a difference in the tempering condition brings about a difference in toughness even if an identical condition is adopted in the subsequent tempering.

Therefore, on the assumption that the as-quenched microstructure governs the toughness after tempering, a part of the manufacturing process of as-quenched steel pipes with poor toughness was carried out and sampled. The microstructures at the center part of the steel pipes of the wall thickness direction were observed in detail by the use of a transmission electron microscope.

Consequently, a large amount of coarse-grained MA was generated in the interfaces of upper bainite, such as prior austenite grain boundary, bainite-packet boundary, bainite-block interface, and interface between bainite laths). The presence of retained austenite in MA was confirmed by analyzing diffraction patterns.

On the other hand, with respect to steel pipes with satisfactory toughness, as-quenched steel pipes were also sampled and observed in the same manner. As a result, it was confirmed that the MA amount was apparently small. It was also found that a sufficiently increased strength needs a suppression of the polygonal ferrite phase.

The cause of generating a large amount of MA is conceivably as follows. An austenite single phase is successively transformed to ferrite, bainite or martensite at the time of cooling during quenching. At the time, when the cooling rate is reduced, the steel pipe passes through a high temperature range for a comparatively long time, C discharged from the ferrite phase or bainite microstructure is progressively diffused and condensed to untransformed austenite. The austenite containing the condensed C is changed to martensite or bainite with high C content or retained austenite with high C content after final transformation.

Since the cooling rate is reduced particularly in thick wall pipes, these pipes are in a state where MA easily generates. Therefore, in order to minimize the generation of the MA, it is preferable to increase the cooling rate as much as possible and in addition to perform forced cooling to a temperature as low as possible.

However, since there is an upper limit in the cooling rate for the thick wall steel pipes, a technique has been researched forming a uniform microstructure, even at the cooling rate of thick wall pipes. As a result, the following points became known.

The precipitation of cementite during quenching is promoted by reducing the content of Si, in addition to reducing the content of C that is a condensing element, whereby concentration of C to the austenite phase can be suppressed.

Based on the above-mentioned findings, the toughness of steel pipes, after tempering, can be improved by limiting the volume ratio of MA to not more than 10%, preferably to not more than 7%, and further preferably to not more than 5%, in addition to limiting the volume ratio of polygonal ferrite phase to not more than 20% during quenching.

The volume ratio of MA was calculated by corroding an observation surface by the La Perla's etching method, optionally observing 10 fields with 50×50 μm as one field at 1000-fold magnification by using an optical microscope, and determining area ratios by image processing. An average value of 10 fields was taken as the area ratio of MA. The volume ratio of the polygonal ferrite phase was determined by corroding an observation surface by nital corrosion, and performing the same observation, photographing and image analysis as described above.

Further examinations were made to clarify the following alloy design and optimum manufacturing process, whereby the present invention was attained. In the following description, "%" related to chemical composition represents "% by mass", unless otherwise specified.

The content of C is limited to not more than 0.08%, more preferably to not more than 0.06%, and further preferably to not more than 0.04%. The upper limit of Si is set to not more than 0.25%. The content of Si is further preferably not more than 0.15% and most preferably not more than 0.10%.

N that shows the same behavior as C exists inevitably in steel. Therefore, N is fixed as nitrides by adding Ti. In this case, the content of Ti should be 0.002 to 0.02%, since an excessively small content minimizes the effect of fixing N, and an excessively large content causes coarse-grained nitrides and uneven precipitation of carbides. The Ti content more preferably ranges from 0.002 to 0.015%, and further preferably from 0.004 to 0.015%.

Other elements are adjusted from the point of the balance between high strength and satisfactory toughness. With respect to P and S that adversely affect the toughness, the upper limit values are set, respectively. The contents of Mn, Cr, Ni, Mo and Cu must be adjusted according to an intended strength, considering the toughness and weldability. Al and Ca that are necessary for deoxidation are added. Further, Mg and REM can be selectively added to ensure casting characteristic or improve the toughness.

Further, in the steel pipe to be manufactured in the inline heat treatment, Nb should not be added, and its upper limit as impurities must be controlled to less than 0.005%. V is not added, or if it is added it must be controlled to the content of not more than 0.08%. B may be selectively added in order to sufficiently enhance the hardenability.

During the manufacturing process, it is important to quench the steel pipe at a high cooling rate from the temperature range of austenite single phase. Therefore, a large quantity of cooling water is brought into contact with both the inside and outside surfaces of the steel pipe. A lower temperature of cooling water is more preferable, and a longer contact time of the steel pipe with cooling water is more preferable. The reduction in temperature of cooling water or the long time water cooling should be determined, considering the manufacturing cost and production efficiency.

A preferable average cooling rate of the steel pipe during the quenching is not less than 5° C./s at a temperature ranging from 800 to 500° C. More preferable rate is not less than 10° C./s, and the further preferable rate is not less than 20° C./s. The finishing temperature of the forced cooling is set to not higher than 200° C. at the temperature of the center part of the thickness of the steel pipe. More preferably, the finishing temperature is not higher than 100° C., and further preferably, the finishing temperature is not higher than 50° C. A lower water temperature is more preferable for executing water quenching, and a temperature of not higher than 50° C. is suitable.

The tempering successively to the quenching is executed in a temperature range from 550° C. to the $Ac_1$ transformation point with a soaking time of 5 to 60 minutes since uniform precipitation of the cementite is important for the improvement in toughness. The tempering is carried out in a temperature range preferably from 600° C. to the $Ac_1$ transformation point, and further preferably from 650° C. to the $Ac_1$ transformation point.

The present invention based on the knowledge described above includes steel pipes and a manufacturing method thereof.

(1) An as-quenched seamless steel pipe having a chemical composition consisting of, by mass %, C: 0.03 to 0.08%, Mn: 0.3 to 2.5%, Al: 0.001 to 0.10%, Cr: 0.02 to 1.0%, Ni: 0.02 to 1.0%, Mo: 0.02 to 0.8%, Ti: 0.004 to 0.010%, N: 0.002 to 0.008%, Ca: 0.0005 to 0.005%, and the balance Fe and impurities, with not more than 0.25% of Si, not more than 0.05% of P, not more than 0.005% of S, less than 0.005% of Nb, and less than 0.0003% of B as the impurities, and having a microstructure consisting of not more than 20 volume % of polygonal ferrite, not more than 10 volume % of a mixed microstructure of martensite and retained austenite, and the balance bainite.

(2) An as-quenched seamless steel pipe according to (1) above, further including, instead of a part of Fe, not more than 0.08 mass % of V.

(3) An as-quenched seamless steel pipe according to (1) or (2) above, further including, instead of a part of Fe, not more than 1.0 mass % of Cu.

(4) An as-quenched seamless steel pipe according to any one of (1) to (3) above, further including, instead of a part of Fe, one or more elements selected from the group consisting of not more than 0.005 mass % of Mg and not more than 0.005 mass % of REM.

(5) An as-quenched seamless steel pipe according to any one of (1) to (4) above, wherein the content of B is 0.0003 to 0.01 mass %.

(6). A method for manufacturing a seamless steel pipe according to any one of (1) to (5) above, comprising rolling a steel having a chemical composition described in any one of (1) to (5) above into a pipe, quenching the steel pipe immediately while the temperature of any part of the steel pipe is not lower than the $Ar_3$ transformation point, or quenching the steel pipe after soaking in a holding furnace in a temperature ranging from the $Ac_3$ transformation point to 1000° C., wherein the quenching is performed by forced cooling to a finishing temperature under 200° C. with the average cooling rate of not less than 5° C./sec in a temperature ranging from 800° C. to 500° C.

(7) A method for manufacturing a seamless steel pipe according to (6) above, wherein tempering is performed in a temperature ranging from 550° C. to the $Ac_1$ transformation point after the quenching.

The above-mentioned seamless steel pipes of (1) to (5) are as-quenched pipes and (6) is the method for manufacturing these steel pipes. (7) is a method for manufacturing a product steel pipe characterized by tempering successively to the quenching of the method (6). The steel pipe subjected to quenching and tempering preferably has a wall thickness of not less than 25 mm and a yield strength of not less than 483 MPa, and such a seamless steel pipe is extremely suitable for a thick wall seamless steel pipe with high strength for a line pipe.

BEST MODE FOR CARRYING OUT THE INVENTION

1. Chemical Composition of Steel Pipe

The reason for limiting the chemical composition of steel pipes as described above in the present invention will be explained.

C: 0.03 to 0.08%

C is an element important for ensuring the strength of steel. In order to enhance the hardenability enough to obtain strength of not less than X70 class in thick wall pipes, not less than 0.03% of C is needed. On the other hand, if the content exceeds 0.08%, the toughness deteriorates. Therefore, the content ranges from 0.03 to 0.08%. The content of C preferably ranges from 0.03 to 0.07%, and further preferably from 0.03 to 0.06%.

Mn: 0.3 to 2.5%

Mn needs to be added in a relatively large quantity in order to enhance the hardenability enough to strengthen thick wall pipes even to the center and also to enhance the toughness. These effects cannot be obtained with a Mn content of less than 0.3%, and a content exceeding 2.5% causes deterioration of toughness. Therefore, the Mn content ranges from 0.3 to 2.5%.

Al: 0.001 to 0.10%

Al is added as a deoxidization agent in steel making. In order to obtain this effect, a content of not less than 0.001% is needed. However, a content exceeding 0.10% causes clustering of inclusions, resulting in deterioration of toughness or frequent occurrence of surface defects during pipe end beveling working. Therefore, the content of Al ranges from 0.001 to 0.10%. For preventing the surface defects, it is preferable to set the upper limit to a lower level. Namely, it is preferable that the upper limit is 0.03%, and it is most preferable that the upper limit be 0.02%.

Cr: 0.02 to 1.0%

Cr is an element that improves the hardenability enough to improve the strength of steel in thick wall pipes. In the case of a content of not less than 0.02%, this effect is remarkable.

However, since an excessive addition causes some deterioration of toughness, the upper limit of the content should be 1.0%.

Ni: 0.02 to 1.0%

Ni is an element that improves the hardenability of steel enough to improve the strength of thick wall pipes. This effect is remarkable with a content of not less than 0.02%. However, since Ni is an expensive element and the effect is saturated by excessive addition, the upper limit should be 1.0%.

Mo: 0.02 to 0.8%

Mo is an element that improves the strength of steel due to transformation reinforcement and solid solution reinforcement. This effect is remarkable at a content of not less than 0.02%. However, since an excessive content of Mo causes deterioration of toughness, the upper limit should be 0.8%.

Ti: 0.004 to 0.010% Ti binds to N in steel to form TiN, suppressing the coarse-grained austenite during hot pipe making. In order to obtain such an effect of Ti, a content of not less than 0.004% is needed. However, if the content of Ti exceeds 0.010%, Ti is concentrated by solidification segregation to form TiN during the solidification, which starts growing coarse-graining at a high temperature, and causes deterioration of the toughness. Therefore, the content of Ti should be 0.004 to 0.010%. The preferable range of Ti content is from 0.006 to 0.010%.

N: 0.002 to 0.008%

N exists inevitably in steel, and binds to Al, Ti, or the like to form nitrides. The presence of a large quantity of N causes coarse-grained nitrides, which deteriorate the toughness. On the other hand, when the content of N is smaller than 0.002%, the quantity of nitrides is too small to obtain the effect of suppressing the coarse-graining of austenite during hot pipe making. Therefore, the content of N ranges from 0.002 to 0.008%. The preferable range of N content is from 0.004 to 0.007%.

Ca: 0.0005 to 0.005%

Ca is added as a deoxidization agent in steel making and for suppressing nozzle clogging in casting in order to improve the casting property. Since Si is controlled lower in order to suppress MA in the present invention, the addition of Ca is necessary for ensuring sufficient deoxidation, with a content of not less than 0.0005%. On the other hand, when the content exceeds 0.005%, the effect saturates, and the toughness deteriorates because inclusions are easily clustered. Therefore, the upper limit should be 0.005%.

V: 0 to 0.08%

V could be added if necessary. V is an element the content of which is to be determined depending on the balance between strength and toughness. When a sufficient strength can be ensured by the addition of other alloy elements, no addition thereof will provide more satisfactory toughness. When it is added for improving the strength, a content of not less than 0.02% is desirable. Since a content exceeding 0.08% causes significant deterioration of toughness, the upper limit of V content is 0.08% if added.

Cu: 0 to 1.0%

Cu is also an element to be added if necessary. Since Cu has the effect of improving hydrogen induced cracking resistance (HIC resisting characteristic), it may be added if improvement in the HIC resisting characteristic is desired. The content desirable for improving the HIC resisting characteristic is not less than 0.02%. On the other hand, since a content exceeding 1.0% causes saturation of the effect, the upper limit of Cu content is 1.0% if added.

B: less than 0.0003% or 0.0003 to 0.01%

No addition of B is advantageous for the toughness. Particularly, when emphasis is on the toughness, B should not be added, wherein the content of B as impurities must be controlled to less than 0.0003%. On the other hand, when emphasis is on the strength, B can be added to enhance the hardenability and the strength. In order to obtain this effect, a content of not less than 0.0003% is needed if added. Since an excessive addition thereof causes deterioration of toughness, the upper limit of B content is set to 0.01% if added.

Mg and REM: 0 to 0.005%

The addition of Mg and REM is not necessary. However, since these elements have the effects of improving the toughness and corrosion resistance by shape control of inclusions and improving the casting characteristic by suppression of nozzle clogging in casting, these elements can be added when these effects are desired. In order to obtain these effects, a content of not less than 0.005% is desired for each element. On the other hand, when the content of each element exceeds 0.005%, the effect saturates and the toughness and HIC resistance deteriorate because the inclusions are easily clustered. Therefore, the upper limit of each element is 0.005% if added. The REM referred to herein is the generic name of 17 elements consisting of 15 elements from La of atomic No. 57 to Lu of 71, Y and Sc, and the above-mentioned content means the content of each element or a total content thereof.

The upper limit of impurities will be described below.

Si: Not more than 0.25%

Si acts as a deoxidization agent in steel making. However, it significantly reduces the toughness of thick wall pipes. When the content exceeds 0.25%, a large amount of MA generates, which causes the deterioration of toughness. Therefore, the content thereof should be not more than 0.25%. Lower content of N improves the toughness more. It is preferable that the Si content be not more than 0.15%. It is more preferable that the Si content be less than 0.10%. It is most preferable that the Si content be less than 0.05%.

P: Not more than 0.05%

P is an impurity element that deteriorates the toughness, and it is preferably reduced as much as possible. Since a content exceeding 0.05% causes remarkable deterioration of toughness, the upper limit should be 0.05%, preferably 0.02%, and more preferably 0.01%.

S: Not more than 0.005%

S is an impurity element that deteriorates the toughness, and it is preferably reduced as much as possible. Since a content exceeding 0.005% causes remarkable deterioration of toughness, the upper limit should be 0.005%, preferably 0.003%, and more preferably 0.001%.

Nb: Not more than 0.005%

In the inline heat treatment adopted in the present invention, it is better not to add Nb since Nb carbonitrides are unevenly precipitated, increasing the dispersion of strength. The Nb content of not less than 0.005 causes a remarkable dispersion of strength in manufacturing. Therefore, Nb should not be added in the steel pipes of the present invention, wherein the content of Nb as impurities must be controlled to less than 0.005%.

2. Microstructure

It is important for improvement in the balance between strength and toughness to adjust the chemical composition of steel as above-mentioned, and to make microstructures as described below. Namely, in the as-quenched steel pipes, polygonal ferrite is controlled to not more than 20% by volume ratio, and the MA (mixture of martensite and retained austenite) is controlled to not more than 10%, preferably to less than 7%, and more preferably to not more than 5%, with the balance bainite.

The method for analyzing the microstructures comprises collecting a test piece of 10 10 mm for microstructure observation from the center part of an as-quenched thick wall steel pipe, performing nital corrosion or La Perla's etching thereto, observing the resulting piece by using a scanning electron microscope, photographing at random 10 fields with 50 50 μm as one field at 1000-fold magnification, determining the area ratios of the respective microstructures by using an image analysis software, and calculating the average area ratios of the respective microstructures, which can lead to the volume ratios.

3. Manufacturing Process

A suitable manufacturing process of the present invention will be described below.

(1) Casting Process

Steel is refined in a converter or the like so as to have the above-mentioned chemical composition, and solidified in order to obtain an ingot that is material. It is ideal to continuously cast the steel into a round billet shape. However, a process for continuously casting the steel in a square casting mold or casting it as ingot and then blooming it to a round billet can be also adopted. A higher cooling rate of bloom in the casting is advantageous for the toughness of the product because minute dispersion of TiN is better promoted.

(2) Heating Temperature of Billet

The round billet is reheated to a hot workable temperature and subjected to piercing, elongation and shaping rolling. The reheating temperature should not be lower than 1150° C., since a temperature lower than 1150° C. results in an increase of the hot deformation resistance and flaws. On the other hand, the upper limit is desirably set to 1280° C., since a reheating temperature exceeding 1280° C. results in an excessive increase of a heating fuel unit, a reduction in yield due to an increased scale loss, and a shortened life of a heating furnace. The heating is preferably performed at a temperature not higher than 1200° C., since a lower heating temperature is more preferable for enhancing the toughness due to fine graining.

(3) Pipe Making by Hot Rolling

One example of the pipe making process by hot rolling is the Mannesmann-mandrel mill process or the subsequent elongation rolling. If the finishing temperature of the pipe making is not lower than the $Ar_3$ deformation point that is the temperature range of austenite single phase, quenching can be executed immediately after the pipe making, and thermal energy can be advantageously saved. Even if the finishing temperature of the pipe making is below the $Ar_3$ transformation point, the austenite single phase can be obtained by immediately performing the holding of a temperature at not lower than the $Ac_3$ transformation point as described later.

(4) Performing the Holding of Temperature or Reheating after Pipe Making

A pipe is put into a holding furnace immediately after pipe making and soaked at a temperature of not lower than the $Ac_3$ transformation point, whereby the uniformity of temperature in the longitudinal direction of steel pipes can be ensured. In this case, the holding of temperature is performed at a temperature range from the $Ac_3$ transformation point to 1000° C. and a residence time of 5 to 30 minutes, whereby the uniformity of temperature and the suppression of extreme coarse-graining of crystal can be advantageously attained.

(5) Quenching

As the cooling rate in quenching increases, high strength and high toughness are more easily obtained even in thick wall pipes. Namely, as the cooling rate gets closer to a theoretical limit of the cooling rate, higher strength and higher toughness are obtained. The necessary average cooling rate is not less than 5° C./sec at a temperature ranging from 800 to 500° C. The preferable rate is not less than 10° C./sec, and a more preferable rate is not less than 15° C./sec.

The cooling rate corresponds to a reduction of temperature with time in the center part of a thick wall steel pipe, and it may be measured by a thermocouple welded to this portion, or predicted from a combination of heat transfer calculation with measurement.

In order to ensure excellent toughness, the finishing temperature of the forced cooling, in addition to the cooling rate, is also important. It is important to use steel with an adjusted chemical composition and to cool it in a forced manner in order to attain a finishing temperature of 200° C. or lower. The finishing temperature is preferably not higher than 100° C., and more preferably not higher than 50° C. As a result, generation of a transformation reinforced microstructure or retained austenite with partially concentrated C can be suppressed, which significantly improves the toughness.

(6) Tempering

After the quenching, tempering is performed at a temperature ranging from 550° C. to the $Ac_1$ transformation point. The holding time at the tempering temperature may be properly determined, and generally set to about 10 to 120 minutes. The tempering temperature is preferably ranged from 600° C. to the $Ac_1$ transformation point, and since the MA is more easily decomposed to cementite at a higher temperature, the toughness is improved.

EXAMPLES

Steels having chemical compositions shown in Table 1 were melted in a converter and made into round billets by a continuous casting machine, which are materials of steel pipes. Each round billet was subjected to heat treatment of soaking at 1250° C. for 1 hour, and then made into a hollow pipe by using an inclined roll piercing mill. The hollow pipe was finish-rolled by using a mandrel mill and a sizer in order to obtain steel pipes with wall thicknesses of 25 mm and 50 mm.

The above-mentioned steel pipes were cooled in quenching conditions shown in Table 2. Namely, they were charged into a holding furnace immediately after pipe making, soaked, and then cooled. The average cooling rates shown in Table 2 were determined as follows. The longitudinal center part of each steel pipe was drilled from the outer surface, a thermocouple was welded to the position corresponding to the center part of the thickness in order to measure the temperature change at a temperature ranging from 800 to 500° C., and the average cooling rate at this temperature ranging was determined.

Each quenched steel pipe was equally divided to two parts vertically to the longitudinal direction, a small piece (10-mm cube) for microstructure examination was sampled from the cut surface of the center part of the thickness, subjected to nital corrosion or La Perla's etching, and observed by using a scanning electron microscope, photographing at random 10 fields with 50 50 μm as one field at 1000-fold magnification, determined the area ratios of the respective microstructures of polygonal ferrite and MA by using image analysis software, and calculating the average area ratios , which lead to the volume ratios(%). The volume ratio of bainite is a value obtained by subtracting the total volume ratio of polygonal ferrite and MA from 100%.

Grain size numbers defined in JIS G0551 (1998) and volume ratios of polygonal ferrite and MA are shown in Tables 3 and 4.

One part of each steel pipe cut was executed to quench and temper in conditions described in Table 2. A tensile test piece of JIS No. 12 was sampled from each product steel pipe after tempering so as to measure tensile strength (TS) and yield strength (YS). The tensile test was carried out according to JIS Z2241. An impact test piece, a 2 mm-V-notch test piece of 10 mm×10 mm, was sampled from the longitudinal direction of the center of the wall thickness according to a test piece of JIS Z2202 No. 4, and subjected to tests. With respect to the strength, those with YS of not less than 483 MPa (the lower limit of yield strength of X70 grade of API standard) are regarded to be successful, and with respect to the toughness, those with energy transition temperatures vTE (° C.) determined by the impact test of not higher than 0° C. are regarded to be successful.

With respect to the steel pipes with wall thicknesses of 25 mm and 50 mm, the volume ratios of polygonal ferrite and MA of as-quenched steel pipes and YS and vTE of product steel pipes after tempering, which were obtained in the above-mentioned tests, are shown in Tables 3 and 4, respectively. Test Nos. 1 to 10, 15 to 17, 20 to 29 and 34 to 36 satisfy the chemical composition and the manufacturing process, defined by the present invention, were also satisfied. Satisfactory toughness was also obtained.

Test Nos. 11 to 14 and 30 to 33 are comparatives using steels which do not satisfy the chemical composition defined by the present invention, and the resulting pipes are poor in toughness after tempering. They cannot be used in steels requiring high strength and high toughness with large wall thickness. Test Nos. 18, 19, 37 and 38 satisfy the chemical composition defined by the present invention, but do not satisfy the manufacturing condition defined by the present invention. Therefore, the resulting steel pipes are poor in toughness with a large quantity of the MA in the as-quenched states, and cannot be used in steels requiring high strength and high toughness with a large wall thickness.

[Table 1]

TABLE 1

| | Chemical composition [mass %, bal: Fe] | | | | | | | | | | |
|---|---|---|---|---|---|---|---|---|---|---|---|
| Steel | C | Si | Mn | P | S | Cr | Ni | Mo | Ti | sol. Al | N |
| A | 0.05 | 0.12 | 1.85 | 0.008 | 0.0010 | 0.32 | 0.07 | 0.22 | 0.006 | 0.025 | 0.0051 |
| B | 0.03 | 0.08 | 1.46 | 0.006 | 0.0013 | 0.27 | 0.10 | 0.21 | 0.008 | 0.015 | 0.0053 |
| C | 0.06 | 0.11 | 1.77 | 0.012 | 0.0009 | 0.35 | 0.12 | 0.18 | 0.009 | 0.024 | 0.0045 |
| D | 0.04 | 0.07 | 1.26 | 0.008 | 0.0010 | 0.36 | 0.16 | 0.24 | 0.008 | 0.024 | 0.0046 |
| E | 0.06 | 0.21 | 1.83 | 0.010 | 0.0011 | 0.41 | 0.20 | 0.26 | 0.010 | 0.022 | 0.0053 |
| F | 0.05 | 0.11 | 1.45 | 0.008 | 0.0011 | 0.30 | 0.08 | 0.21 | 0.008 | 0.025 | 0.0045 |
| G | 0.05 | 0.09 | 1.46 | 0.008 | 0.0008 | 0.35 | 0.20 | 0.25 | 0.012 | 0.025 | 0.0061 |
| H | 0.06 | 0.23 | 1.05 | 0.006 | 0.0005 | 0.60 | 0.22 | 0.30 | 0.010 | 0.020 | 0.0033 |
| I | 0.05 | 0.08 | 1.53 | 0.008 | 0.0010 | 0.33 | 0.10 | 0.22 | 0.008 | 0.024 | 0.0045 |
| J | 0.03 | 0.11 | 1.80 | 0.009 | 0.0008 | 0.20 | 0.05 | 0.15 | 0.012 | 0.025 | 0.0045 |
| K | 0.07 | 0.41 | 1.55 | 0.009 | 0.0009 | 0.39 | 0.10 | 0.07 | 0.009 | 0.020 | 0.0067 |
| L | 0.11 | 0.10 | 1.46 | 0.008 | 0.0011 | 0.44 | 0.14 | 0.16 | 0.007 | 0.027 | 0.0040 |
| M | 0.06 | 0.18 | 2.10 | 0.007 | 0.0008 | 0.43 | 0.15 | 0.15 | 0.010 | 0.022 | 0.0050 |
| N | 0.05 | 0.15 | 1.60 | 0.005 | 0.0010 | 0.33 | 0.15 | 0.18 | 0.021 | 0.018 | 0.0045 |

| | Chemical composition [mass %, bal: Fe] | | | | | | | Transformation point | |
|---|---|---|---|---|---|---|---|---|---|
| Steel | V | Cu | Nb | B | Ca | Mg | REM | $Ac_1$ (° C.) | $Ac_3$ (° C.) |
| A | 0.04 | — | <0.0001 | <0.0002 | 0.0007 | — | — | 736 | 888 |
| B | 0.04 | — | <0.0002 | <0.0002 | 0.0009 | — | — | 739 | 902 |
| C | 0.06 | — | <0.0002 | <0.0002 | 0.0025 | — | — | 734 | 882 |
| D | 0.03 | — | <0.0003 | <0.0002 | 0.0022 | — | — | 742 | 900 |
| E | 0.05 | — | <0.0002 | 0.0008 | 0.0007 | 0.0010 | — | 737 | 887 |
| F | 0.05 | 0.11 | <0.0003 | <0.0002 | 0.0010 | — | — | 736 | 893 |
| G | 0.04 | 0.25 | <0.0003 | <0.0002 | 0.0018 | 0.0007 | — | 732 | 888 |
| H | — | — | <0.0002 | <0.0002 | 0.0015 | — | 0.0006 | 754 | 903 |
| I | 0.05 | 0.10 | <0.0003 | <0.0002 | 0.0020 | 0.0005 | 0.0005 | 736 | 890 |
| J | 0.02 | — | <0.0002 | 0.0011 | 0.0008 | — | — | 733 | 897 |
| K | — | 0.31 | <0.0003 | <0.0002 | 0.0014 | — | — | 737 | 889 |
| L | 0.03 | 0.32 | <0.0002 | <0.0002 | 0.0012 | — | — | 731 | 856 |
| M | 0.13 | 0.12 | <0.0002 | <0.0001 | 0.0016 | — | — | 727 | 875 |
| N | 0.03 | — | <0.0002 | <0.0001 | 0.0027 | — | — | 738 | 891 |

Note:

The underlined values show out of scope of the invention.

[Table 2]

TABLE 2

| Test No. | Thickness (mm) | Finishing temperature of rolling (° C.) | Holding temperature (° C.) | Holding time (min) | Off-line heating | Starting temperature of cooling (° C.) | Cooling rate (° C./s) | Finishing temperature of cooling (° C.) | Tempering temperature (° C.) | Tempering time (min) |
|---|---|---|---|---|---|---|---|---|---|---|
| 1 to 14 | 25 | 900 to 1100 | 950 | 5 to 10 | non | 930 | 30 | 50 | 650 | 10 to 30 |
| 15 to 17 | 25 | 1000 to 1100 | non | non | non | 930 | 30 | 50 | 650 | 10 to 30 |
| 18 | 25 | 1000 | 950 | 10 | non | 930 | 4.5 | 50 | 650 | 30 |
| 19 | 25 | 1000 | 950 | 10 | non | 930 | 30 | 250 | 650 | 30 |
| 20 to 33 | 50 | 900 to 1100 | 950 | 5 to 10 | non | 930 | 10 | 50 | 650 | 10 to 30 |
| 34 to 36 | 50 | 900 to 1100 | non | non | non | 930 | 10 | 50 | 650 | 10 to 30 |
| 37 | 50 | 1050 | 950 | 10 | non | 930 | 3.0 | 50 | 650 | 30 |
| 38 | 50 | 1050 | 950 | 10 | non | 930 | 10 | 230 | 650 | 30 |

Note:
The underlined values show out of scope of the invention.

[Table 3]

TABLE 3

| Test No. | Steel | Thickness (mm) | Prior austenite grain size No. | Polygonal ferrite ratio (%) | Ratio of MA (%) | Ratio of bainite (%) | YS (MPa) | vTE (° C.) | Note |
|---|---|---|---|---|---|---|---|---|---|
| 1 | A | 25 | 7.0 | 5 | 6.5 | 88.5 | 656 | −28 | The invention |
| 2 | B | 25 | 6.5 | 8 | 3 | 89 | 600 | −65 | |
| 3 | C | 25 | 6.8 | 5 | 3 | 92 | 720 | −30 | |
| 4 | D | 25 | 7.2 | 11 | 3 | 86 | 596 | −64 | |
| 5 | E | 25 | 7.0 | 0 | 3 | 97 | 735 | −30 | |
| 6 | F | 25 | 6.1 | 7 | 2 | 91 | 638 | −60 | |
| 7 | G | 25 | 6.0 | 6 | 1.5 | 92.5 | 650 | −65 | |
| 8 | H | 25 | 6.2 | 2 | 5.5 | 92.5 | 715 | −20 | |
| 9 | I | 25 | 6.7 | 10 | 1.5 | 88.5 | 625 | −67 | |
| 10 | J | 25 | 6.0 | 0 | 4 | 96 | 790 | −10 | |
| 11 | K | 25 | 7.0 | 6 | 10 | 84 | 599 | 5 | Comparative |
| 12 | L | 25 | 6.1 | 0 | 12 | 88 | 800 | 34 | |
| 13 | M | 25 | 7.2 | 6 | 3 | 91 | 635 | 8 | |
| 14 | N | 25 | 6.0 | 0 | 3 | 97 | 735 | 12 | |
| 15 | A | 25 | 6.5 | 4 | 6.1 | 89.9 | 665 | −27 | The invention |
| 16 | H | 25 | 6.0 | 2 | 4.8 | 93.2 | 722 | −25 | |
| 17 | I | 25 | 6.5 | 9 | 1 | 90 | 611 | −74 | |
| 18 | A | 25 | 7.1 | 10 | 18.5 | 71.5 | 508 | 10 | Comparative |
| 19 | C | 25 | 6.8 | 0 | 20 | 80 | 720 | 35 | |

[Table 4]

TABLE 4

| Test No. | Steel | Thickness (mm) | Prior austenite grain size No. | Polygonal ferrite ratio (%) | Ratio of MA (%) | Ratio of bainite (%) | YS (MPa) | vTE (° C.) | Note |
|---|---|---|---|---|---|---|---|---|---|
| 20 | A | 50 | 6.5 | 14 | 8.5 | 77.5 | 595 | −30 | The invention |
| 21 | B | 50 | 6.0 | 20 | 5.0 | 75.0 | 499 | −60 | |
| 22 | C | 50 | 6.1 | 5 | 6.0 | 89.0 | 650 | −30 | |
| 23 | D | 50 | 6.5 | 14 | 4.0 | 82.0 | 488 | −65 | |
| 24 | E | 50 | 5.8 | 2 | 5.5 | 92.5 | 665 | −26 | |
| 25 | F | 50 | 5.9 | 10 | 4.0 | 86.0 | 585 | −56 | |
| 26 | G | 50 | 6.0 | 8 | 3.5 | 88.5 | 600 | −60 | |
| 27 | H | 50 | 5.8 | 7 | 6.5 | 86.5 | 625 | −24 | |
| 28 | I | 50 | 6.3 | 12 | 3.6 | 84.4 | 565 | −66 | |
| 29 | J | 50 | 6.0 | 3 | 6.0 | 91.0 | 730 | −15 | |
| 30 | K | 50 | 6.6 | 15 | 13.5 | 71.5 | 545 | 10 | Comparative |
| 31 | L | 50 | 5.7 | 8 | 15.2 | 76.8 | 645 | 24 | |
| 32 | M | 50 | 6.6 | 5 | 3.0 | 92.0 | 745 | 30 | |
| 33 | N | 50 | 6.0 | 14 | 4.0 | 82.0 | 559 | 15 | |
| 34 | A | 50 | 6.0 | 10 | 7.0 | 83.0 | 610 | −41 | The invention |
| 35 | H | 50 | 5.6 | 5 | 5.5 | 89.5 | 640 | −30 | |
| 36 | I | 50 | 6.0 | 10 | 3.0 | 87.0 | 575 | −70 | |

TABLE 4-continued

| Test No. | Steel | Thickness (mm) | Prior austenite grain size No. | Polygonal ferrite ratio (%) | Ratio of MA (%) | Ratio of bainite (%) | YS (MPa) | vTE (° C.) | Note |
|---|---|---|---|---|---|---|---|---|---|
| 37 | A | 50 | 6.5 | 23 | 16.5 | 60.5 | 486 | 5 | Comparative |
| 38 | C | 50 | 6.2 | 7 | 13.5 | 79.5 | 650 | 26 | |

INDUSTRIAL APPLICABILITY

According to the seamless steel pipes and the manufacturing method thereof of the present invention, the chemical composition of the seamless steel pipes and the manufacturing method thereof are defined, whereby a seamless steel pipe for submarine flow line with a particularly thick wall, which has high strength of not less than 483 MPa by yield strength and excellent toughness can be manufactured. The present invention enables providing of a seamless steel pipe that can be laid in deeper seas, and significantly contributes to stable supply of energies in the world.

The invention claimed is:

1. A quenched and tempered seamless steel pipe with a wall thickness of not less than 25 mm having a chemical composition, comprising, by mass %, C: 0.03 to 0.08%, Mn: 0.3 to 2.5%, Al 0.001 to 0.10%, Cr: 0.02 to 1.0%, Ni: 0.02 to 1.0%, Mo: 0.02 to 0.8%, Ti: 0.004 to 0.010%, N: 0.002 to 0.008%, Ca: 0.0005 to 0.005%, and the balance being Fe and impurities, with less than 0.10% of Si, not more than 0.05% of P, not more than 0.005% of S, less than 0.005% of Nb, and less than 0.0003% of B as the impurities, wherein the steel pipe before tempering has a microstructure consisting of not more than 12 volume % of polygonal ferrite, not more than 3.6 volume % of a mixed microstructure of martensite and retained austenite, and the balance being bainite, and the steel pipe after being tempered has a yield strength of not less than 565 MPa and an energy transition temperature of not higher than −60° C.

2. A quenched and tempered seamless steel pipe according to claim 1, further containing, instead of a part of Fe, by mass %, one or more elements selected from V: not more than 0.08%, Cu: not more than 1.0%, Mg:

not more than 0.005%, REM: not more than 0.005%.

3. A quenched and tempered seamless steel pipe with a wall thickness of not less than 25 mm having a chemical composition, comprising, by mass %, C: 0.03 to 0.08%, Mn: 0.3 to 2.5%, Al 0.001 to 0.10%, Cr: 0.02 to 1.0%, Ni: 0.02 to 1.0%, Mo: 0.02 to 0.8%, Ti: 0.004 to 0.010%, N: 0.002 to 0.008%, Ca: 0.0005 to 0.005%, B: 0.0003 to 0.01%, and the balance being Fe and impurities, with less than 0.10% of Si, not more than 0.05% of P, not more than 0.005% of S, and less than 0.005% of Nb as the impurities, wherein the steel pipe before tempering has a microstructure consisting of not more than 12 volume % of polygonal ferrite, not more than 3.6 volume % of a mixed microstructure of martensite and retained austenite, and the balance being bainite, and the steel pipe after being tempered has a yield strength of not less than 565 MPa and an energy transition temperature of not higher than −60° C.

4. A quenched and tempered seamless steel pipe according to claim 3, further containing, instead of a part of Fe, by mass %, one or more elements selected from V: not more than 0.08%, Cu: not more than 1.0%, Mg: not more than 0.005% and REM: not more than 0.005%.

* * * * *